US011104122B2

(12) United States Patent
Luo

(10) Patent No.: US 11,104,122 B2
(45) **Date of Patent: *Aug. 31, 2021**

(54) APPARATUS AND PROCESS FOR PRINTING BEER BARRELS

(71) Applicant: Ningbo Major Draft Beer Equipment Co., Ltd, Ningbo (CN)

(72) Inventor: Bangcai Luo, Ningbo (CN)

(73) Assignee: NINGBO MAJOR DRAFT BEER EQUIPMENT CO., LTD., Ningbo (CN)

( * ) Notice: Subject to any disclaimer, the term of this patent is extended or adjusted under 35 U.S.C. 154(b) by 350 days.

This patent is subject to a terminal disclaimer.

(21) Appl. No.: 16/300,427

(22) PCT Filed: Jul. 5, 2016

(86) PCT No.: PCT/CN2016/088598
§ 371 (c)(1),
(2) Date: Nov. 9, 2018

(87) PCT Pub. No.: WO2017/193464
PCT Pub. Date: Nov. 16, 2017

(65) Prior Publication Data

US 2019/0160807 A1 May 30, 2019

(30) Foreign Application Priority Data

May 10, 2016 (CN) ..... 201610303861.6
May 10, 2016 (CN) ..... 201620418749.2

(51) Int. Cl.
*B41F 17/20* (2006.01)
*B41M 1/40* (2006.01)
(Continued)

(52) U.S. Cl.
CPC ..... *B41F 17/20* (2013.01); *B41F 13/004* (2013.01); *B41F 17/18* (2013.01); *B41F 17/22* (2013.01);
(Continued)

(58) Field of Classification Search
CPC ..... B41F 17/20; B41F 17/18; B41F 17/22; B41F 13/004; B41F 17/002; B41F 17/008;
(Continued)

(56) References Cited

U.S. PATENT DOCUMENTS 10,086,601 B2 * 10/2018 Luo ..... B65D 85/72

FOREIGN PATENT DOCUMENTS

CN 2698581 Y 5/2005
CN 2820532 Y 9/2005
(Continued)

OTHER PUBLICATIONS

English language machine translation of CN103935117A. (Year: 2014).*

(Continued)

*Primary Examiner* — Leslie J Evanisko
(74) *Attorney, Agent, or Firm* — Wood, Phillips, Katz, Clark & Mortimer

(57) ABSTRACT

An apparatus for printing a beer barrel includes a workbench, and a hydraulic pushing device, a barrel outer-sided printing device, and a barrel inner-sided printing device installed on the workbench. The barrel inner-sided printing device has a turntable rotating with respect to the Z-axis and mounted on the barrel, an inner mold installed onto a circumferential surface of the turntable for printing the inner side of the barrel. The barrel outer-sided printing device has a connecting frame moving linearly along the Y-axis direction. The connecting frame has an outer mold for printing an
(Continued)

outer side of the barrel, and the hydraulic pushing device controls the outer mold to move linearly along the X-axis direction. The outer and inner molds print a sidewall of the barrel. This invention prevents unnecessary waste of manufacturing cost and time caused by the scrap of semi-finished products whose previous printing process becomes useless.

18 Claims, 9 Drawing Sheets

(51) Int. Cl.

| | |
|---|---|
| ***B41K 3/32*** | (2006.01) |
| ***B41K 3/44*** | (2006.01) |
| ***B41F 17/22*** | (2006.01) |
| ***B41F 17/18*** | (2006.01) |
| ***B41K 3/36*** | (2006.01) |
| ***B41F 13/004*** | (2006.01) |
| ***B41M 5/00*** | (2006.01) |

(52) U.S. Cl.
CPC ..... *B41K 3/32* (2013.01); *B41K 3/36* (2013.01); *B41K 3/44* (2013.01); *B41M 5/0058* (2013.01); *B41M 5/0082* (2013.01); *B41M 1/40* (2013.01); *B41P 2217/50* (2013.01); *B41P 2217/53* (2013.01)

(58) Field of Classification Search
CPC ... B41K 3/32; B41K 3/36; B41K 3/44; B41M 5/0058; B41M 5/0082; B41M 1/40; B41P 2217/50; B41P 2217/53; B41P 2217/61; B44B 5/0009; B44B 5/0014; B44B 5/0028; B44B 5/009; B44B 5/022
See application file for complete search history.

(56) References Cited

FOREIGN PATENT DOCUMENTS

| | | | | |
|---|---|---|---|---|
| CN | 201362048 | Y | | 12/2009 |
| CN | 101734028 | A | * | 6/2010 |
| CN | 103935117 | A | | 7/2014 |
| CN | 203739402 | U | | 7/2014 |
| CN | 204278901 | U | | 4/2015 |
| CN | 105799347 | A | * | 7/2016 |
| KR | 2011-0095475 | A | | 8/2011 |

OTHER PUBLICATIONS

International Search Report for corresponding PCT application No. PCT/CN2016/088598 dated Feb. 21, 2017.

* cited by examiner

APPARATUS AND PROCESS FOR PRINTING BEER BARRELS

FIELD OF THE INVENTION

The present invention relates to the technical field of printing, and more particularly to an apparatus and a process for printing beer barrels.

BACKGROUND OF THE INVENTION

Beer barrel is a common container for containing beer. To guarantee the strength of the beer barrel while reducing weight and resisting rust, the beer barrel is usually made of stainless steel. On the body of the beer barrel, related identification information is printed on the body of the beer barrel. In a traditional manufacturing process, a matrix printing tool is provided for printing the identification information on a raw material (such as a stainless steel plate), and then the raw material with the printed identification information is stretched and welded to form the body of the barrel. However, such manufacturing process has the following drawbacks:

If a semi-finished product is scrapped due to an operational error occurred in the stretching and welding processes or any other reasons, the previous printing process will become useless correspondingly, and thus incurring additional manufacturing cost and increasing the manufacturing time.

During the production process, words of a mark may be the same and different, but a beer barrel with all of these words in the mark is molded as a whole. Since the fonts are not all the same, therefore it is necessary to prepare several matrix printing tools with different marks. As a result, the cost for the matrix printing tools and the manufacturing time are increased.

SUMMARY OF THE INVENTION

I. Problem to be Solved

The present invention provides an apparatus and a process for printing barrels after the barrel is stretched and welded to overcome the drawbacks of the traditional manufacturing process which may cause an unnecessary scrap of a semi-finished product when a printed material fails in a stretching or welding process, since the printed material obtained from the previous printing process becomes useless.

II. Technical Solution

To overcome the aforementioned problem, the present invention provides an apparatus for printing a beer barrel, and the apparatus comprises a workbench and a hydraulic pushing device, a barrel outer-sided printing device and a barrel inner-sided printing device installed on the workbench. The barrel inner-sided printing device comprises a turntable rotating by using the Z-axis as an axis line and capable of mounting the barrel, and an inner mold is installed on a circumferential surface of the turntable for printing an inner side of the barrel. The barrel outer-sided printing device comprises a connecting frame moving linearly in the Y-axis direction, and the connecting frame has an outer mold installed thereon for printing an outer side of the barrel. The hydraulic pushing device controls the outer mold on the connecting frame to move linearly along the X-axis direction, so that the outer mold and the inner mold can be operated together to print a sidewall of the barrel.

In the apparatus for printing a beer barrel, the hydraulic pushing device comprises a hydraulic cylinder, a hydraulic cylinder mount, a first guide rail and a moving rack. The hydraulic cylinder is installed on the workbench by the hydraulic cylinder mount, and the first guide rail is laid on a tabletop of the workbench, and the moving rack is installed on the first guide rail, and moved linearly along the X-axis direction by a pushrod of the hydraulic cylinder.

In the apparatus for printing a beer barrel, the barrel outer-sided printing device further comprises a Y-axis servomotor, a screw and a second guide rail. The Y-axis servomotor, screw and second guide rail are installed on the moving rack, and the Y-axis servomotor drives the screw to rotate, and an end of the connecting frame is mounted onto the second guide rail and slidably coupled along the Y-axis and the other end of the connecting frame is spirally coupled to the screw.

In the apparatus for printing a beer barrel, the barrel inner-sided printing device further comprises a Z-axis servomotor and a bearing. The bearing is installed on the workbench, and the turntable is installed in the bearing, and the Z-axis servomotor is installed at the bottom of the workbench and provided for driving the turntable to rotate on the bearing by using the Z-axis as an axis line.

In the apparatus for printing a beer barrel, both of the inner mold and the outer mold include at least a matrix, and the matrix in the single inner mold and the matrix in the single outer mold are paired to form a pair of matrix elements for printing a single text. The matrix is installed on the Y-axis plane of the connecting frame and the circumferential surface of the turntable separately, and the matrix of the connecting frame is pressed along the X-axis, the printing of the single matrix element is completed.

In the apparatus for printing a beer barrel, both of the circumferential surface of the turntable and the Y-axis plane of the connecting frame have at least a dovetail notch of the same size, and each matrix is of the same size. The back side of the matrix is correspondingly latched into the dovetail notch, so that the matrix is installed onto the Y-axis plane of the connecting frame and the circumferential surface of the turntable separately.

In the apparatus for printing a beer barrel, both upper and lower ends of the matrix in the outer mold have a fixing plate coupled to the connecting frame to abut and fix the matrix.

In the apparatus for printing a beer barrel, if the X-axis and the diameter of the turntable are situated on a straight line, then the matrix of the connecting frame at the linear position and the matrix of the turntable at the linear position can be used for normal printing.

The apparatus for printing a beer barrel further comprises a barrel driving mechanism, and the barrel driving mechanism comprises a 3-jaw positioning tool for positioning the barrel and controlling the barrel to rotate axially and independently, and the 3-jaw positioning tool and the turntable are positioned coaxially and can be moved axially.

In the apparatus for printing a beer barrel, the barrel driving mechanism further comprises a third guide rail, a fourth guide rail, a placement plate, a Z-axis cylinder, a first cylinder and a lifting mechanism. The third guide rail and the fourth guide rail are disposed on the workbench and the lifting mechanism respectively and parallel to the Z-axis. The placement plate is installed onto the third guide rail and moved linearly along the third guide rail by the Z-axis cylinder. The 3-jaw positioning tool is installed onto the fourth guide rail and moved linearly along the fourth guide rail by the first cylinder. The lifting mechanism is installed on the placement plate for driving the 3-jaw positioning tool to ascend and descend vertically.

In the apparatus for printing a beer barrel, the 3-jaw positioning tool comprises a chuck mount, a chuck servomotor and a 3-jaw chuck coaxially configured with the turntable. The 3-jaw chuck is installed onto the fourth guide rail by the chuck mount and capable of rotating axially, and a gear is installed onto the back side of the 3-jaw chuck and configured to be coaxially with the 3-jaw chuck. The chuck servomotor is fixed onto the chuck mount and engaged with the gear to rotate the barrel axially and independently with respect to the turntable. The first cylinder is provided for controlling the chuck mount to move along the fourth guide rail.

In the apparatus for printing a beer barrel, the lifting mechanism comprises a lifting cylinder, a lifting plate and a socket bar and a guide rock disposed at the periphery of the placement plate. The lifting cylinder and the socket bar are fixed onto the placement plate. The guide rod is slidably plugged into the socket bar, and the top of the guide rod is coupled to the lifting plate, and the lifting rod of the lifting cylinder drives the lifting plate to ascend and descend vertically, and the fourth guide rail is installed onto the lifting plate.

The apparatus for printing a beer barrel, the beer barrel further comprises a barrel placement mechanism, and the barrel placement mechanism comprises two support members each including a sliding seat, an adjustment mechanism, a positioning plate installed onto the lifting plate and a pair of symmetrical wheels disposed on both left and right sides of the sliding seat respectively. The outer circumferential surface of the rotating wheel is contacted with the outer wall of the barrel, and both left and right ends of the sliding seat are installed onto the fourth guide rail and slid linearly. The positioning plate is disposed at the top of the sliding seat and has a plurality of adjustment holes distributed along the Z-axis. The sliding seat is coupled to the adjustment mechanism by the adjustment hole.

In the apparatus for printing a beer barrel, the sliding seat has a slotted hole, and the slotted hole is fixed to the adjustment hole by the adjustment mechanism.

The apparatus for printing a beer barrel further comprises an abutting mechanism disposed at the top of the barrel placement mechanism. The abutting mechanism comprises a slide block, a second cylinder, a fifth guide rail and a pair of symmetric abutting blocks disposed on both left and right sides of the slide block respectively. Both of the fifth guide rail and the second cylinder are installed onto the hydraulic cylinder mount, wherein the fifth guide rail is parallel to the X-axis. The slide block is installed onto the fifth guide rail and pushed to slide linearly along the fifth guide rail by the second cylinder. An axial end of the barrel is latched to the 3-jaw chuck, and the other end of the barrel abuts against the abutting block.

In the apparatus for printing a beer barrel, the abutting block abuts against a middle position of the barrel.

In the apparatus for printing a beer barrel, the abutting block is made of nylon.

The present invention also provides a process I for printing beer barrels, and the process I comprises the following steps:

Step 1: Install a matrix element onto the Y-axis plane of a connecting frame and the circumferential surface of a turntable separately and arrange and label a plurality of corresponding single texts.

Step 2: Sheath a stretched and welded barrel on the turntable, such that the inner side of the barrel is configured to be corresponsive to a matrix of a male die structure in a matrix element, and the outer side of the barrel is configured to be corresponsive to a matrix of a female die structure in the matrix element, wherein the matrix of the first female die structure and the matrix of the first male die structure are arranged at a printing position Step 3: Move the connecting frame along the X-axis, so that the matrix of the first female die structure touches a sidewall of the barrel and operates together with the matrix of the first male die structure to print a first text on the sidewall of the barrel, and then move the connecting frame in an opposite direction along the X-axis, so that the matrix of the first female die structure and the matrix of the first male die structure are separated from each other Step 4: Move the connecting frame along the Y-axis after the matrix of the first female die structure and the matrix of the first male die structure are separated from each other, so that the matrix of the next female die structure can move to the printing position, and the turntable rotates along the Z-axis so that the barrel and the matrix of the next male die structure also rotate and move to the printing position, and perform the printing as described in Step 3.

Step 5: Print the remaining text by the method as described in Step 4 to complete a labelled printing.

In Step 1, if the text and order of the matrix element used are the same as those of the previously installed matrix element, then the previous matrix element will be kept, and only the matrix element with a different text and a different order will be changed.

In the process I, after the connecting frame moves along the X-axis to separate the matrix of the female die structure and the matrix of the male die structure from one another, the sidewall of the barrel is still printed by the matrix of the male die structure and latched to the matrix of the male die structure, so as to drive the turntable to rotate the barrel along the Z-axis.

The present invention further provides a process II for printing beer barrels, and the process II comprises the following steps:

Step 1: Install a matrix element onto the Y-axis plane of a connecting frame and the circumferential surface of a turntable separately and arrange and label a plurality of corresponding single texts, wherein a matrix of a female die structure is installed on the Y-axis plane of the connecting frame, and a matrix of a male die structure is installed on a circumferential surface of the turntable.

Step 2: Position an end of a stretched and welded barrel by a 3-jaw chuck and move the barrel to a printing position, such that the inner side of the barrel is configured to be corresponsive to a matrix of a male die structure and the outer side of the barrel is configured to be corresponsive to a matrix of a female die structure.

Step 3: Automatically find the matrix of the corresponding female die structure and move the matrix to a printing position by the connecting frame when a first text is printed, and automatically find the matrix of the corresponding male die structure and rotating the matrix along the Z-axis to a printing position by the turntable, and move the matrix of the female die structure along the X-axis by a hydraulic cylinder and operate together with the matrix of the male die structure for printing, and restore the matrix of the female die structure to its original position after the printing is completed, and lift the barrel by a lifting cylinder to separate the barrel from the matrix of the male die structure.

Step 4: Print a next text, and control a 3-jaw chuck independently to rotate the barrel to an appropriate angle first, and then perform the operation as described in Step 3.

Step 5: Use the method as described in Step 4 to print the remaining text, so as to complete the labeled printing.

In the process II, the barrel, the connecting frame, and the turntable have independently controlled power.

In Step 2 of the process II, the barrel is placed horizontally on a barrel placement mechanism, and the 3-jaw chuck moves towards the barrel, so that both ends of the barrel abut against the abutting mechanism and the 3-jaw chuck respectively, and then the 3-jaw chuck is provided for connecting and positioning the barrel, and the abutting mechanism restores its original position along the X-axis, and then the barrel is sent to a printing position.

III. Beneficial Effects

In summation, the apparatus and process for printing a beer barrel in accordance with the present invention have the following advantages:

With the turntable and the connecting frame having the inner mold and the outer mold with the corresponding identification, the stretched and welded barrel is placed on the turntable of this apparatus and pressed by the outer mold and inner mold for printing, so that labels can be printed onto the sidewall of the barrel, so as to achieve the effect of stretching and welding the barrel before printing the barrel. Such arrangement can overcome the drawback of wasting the previous printing when it is necessary to scrap a semi-finished product of the stretched and welded barrel. This invention can simplify the manufacturing procedure and reduce the manufacturing cost and time.

The matrix in the single inner mold and the matrix in the single outer mold are paired and configured to be corresponsive to a pair of matrix elements for printing a single text, and the matrix is installed onto the connecting frame and the turntable separately, so as to divide the matrix printing tool of labeled identification into a plurality of matrix elements of several single texts. During the production process, some of the texts of the labeled identification are the same and some are different. As a result, it is only necessary to change the required matrix and adjust the order, and the original matrix elements of the same text are kept for use, so as to achieve excellent versatility and interchangeability of the same matrix elements for different labeled identifications. Such arrangement not just saves the time of changing the mold only, but also skips the manufacture of several matrix printing tools for different labeled identifications. The invention reduces the manufacturing cost and time of the mold.

By the principle of controlling the servomotor, the matrix can be positioned more accurately while moving and rotating.

After the connecting frame moves along the X-axis to separate the matrix of the female die structure and the matrix of the male die structure from each other, the sidewall of the barrel is still pressed on and latched to the matrix of the male die structure, so that the turntable drives the barrel to rotate along the Z-axis, wherein the turntable may install barrels of different sizes or specifications. Therefore, it no longer needs to prepare several turntables of different sizes, and this invention reduces the manufacturing cost of the apparatus for printing beer barrels.

The barrel outer-sided printing device, the barrel inner-sided printing device and the barrel driving mechanism of the present invention can be controlled independently, so that there will be enough matrixes on the turntable and the connecting frame, and the corresponding printing position can be found automatically according to the inputted printing content. This invention saves lots of time for changing the text and provides a very convenient effect for imprinting an embossed serial number.

Since the barrel driving mechanism can rotate the barrel on the turntable, therefore the gap between two adjacent texts printed on the barrel can be adjusted to make the printed text very beautiful and the distribution of the texts printed on the outer wall of the barrel can be adjusted.

DESCRIPTION OF THE PREFERRED EMBODIMENTS

Figure 1:
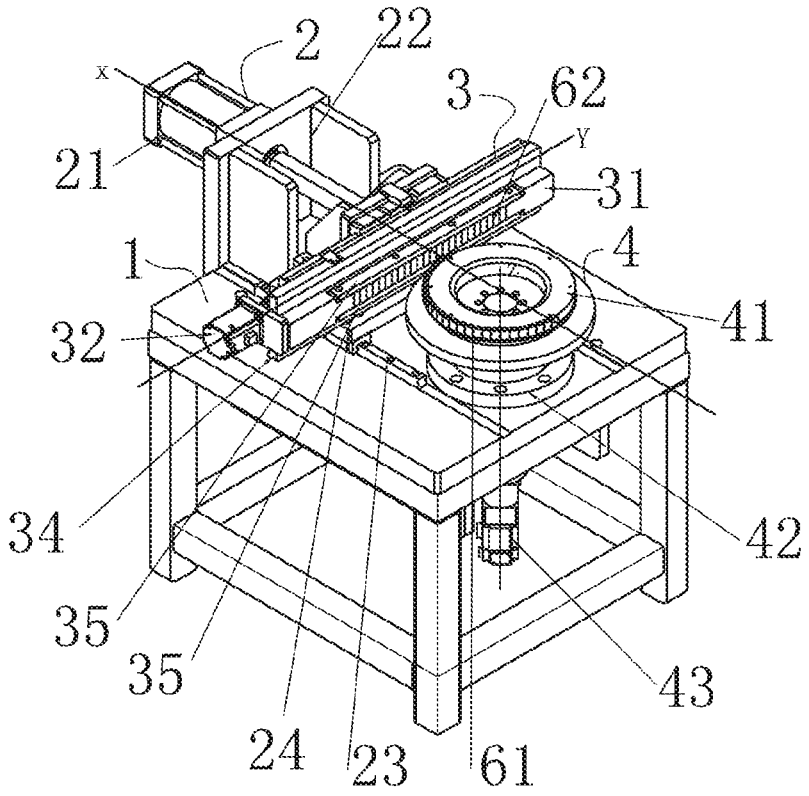
FIG. 1 is a perspective view of a vertical structure of an apparatus for printing a beer barrel in accordance with the present invention.

The technical contents of the present invention will become apparent with the detailed description of preferred embodiments accompanied with the illustration of related drawings as follows. It is intended that the embodiments and figures disclosed herein are to be considered illustrative rather than restrictive.

With reference to FIGS. 1 to 4 for a vertical structure of an apparatus for printing beer barrels in accordance with a first embodiment of the present invention, the apparatus comprises a workbench 1, and a hydraulic pushing device 2, a barrel outer-sided printing device 3 and a barrel inner-sided printing device 4 installed on the workbench 1. The hydraulic pushing device 2 comprises a hydraulic cylinder 21, a hydraulic cylinder mount 22, a first guide rail 23 and a moving rack 24. The hydraulic cylinder 21 is installed onto the workbench 1 by the hydraulic cylinder mount 22, and the first guide rail 23 is laid on a tabletop of the workbench 1, and the moving rack 24 is installed onto the first guide rail 23. The barrel outer-sided printing device 3 comprises a connecting frame 31, a Y-axis servomotor 32, a screw 33 and a second guide rail 34. The Y-axis servomotor 32, the screw 33 and the second guide rail 34 are installed onto the moving rack 24, and the Y-axis servomotor 32 drives the screw 33 to rotate, and the connecting frame has an end installed onto the second guide rail and slidably coupled to the second guide rail along the Y-axis and the other end spirally coupled to the screw, and the connecting frame 31 has an outer mold 62 with a female die structure, such that the outer mold 62 can be moved axially along the Y-axis. The barrel inner-sided printing device 4 comprises a turntable 41, a Z-axis servomotor 42 and a bearing 43. The bearing 43 is installed onto the workbench 1, and an inner mold 61 with a male die structure is installed on a circumferential surface of the turntable 41, and the turntable 41 is installed in the bearing 43, and the servomotor 42 is installed at the bottom of the workbench 1 for driving the inner mold 61 to rotate on the bearing 43 by using the Z-axis as an axis line. The turntable 41 may be sheathed and coupled to the barrel 5, and the outer mold 62 can be moved linearly along the X-axis direction by a pushrod of the hydraulic cylinder 21 and configured to be opposite to the inner mold 61 (and both of their positions are situated on a same horizontal line), and the outer mold 62 is installed on an outer side of the barrel 5, and the inner mold 61 is installed on an inner side of the barrel 5. When the outer mold 62 is moved linearly along the X-axis direction by the pushrod of the hydraulic cylinder 21, the outer mold 62 on the connecting frame 31 moves linearly along the X-axis direction, so that the outer mold 62 and the inner mold 61 can be operated together for the printing of a sidewall of the barrel 5.

With the apparatus of the present invention, a complete mark can be printed, and the effect of stretching and welding the barrel before printing the barrel can be achieved. The invention overcomes the drawbacks of the traditional manufacturing process which may cause an unnecessary scrap of a semi-finished product when a printed material fails in a stretching or welding process, since the printed material obtained from the previous printing process becomes useless. The invention also simplifies the manufacturing procedure to reduce the manufacturing cost and time. By the control of the servomotor, the outer mold 62 and the inner mold 61 can be moved more accurately.

Figure 2:
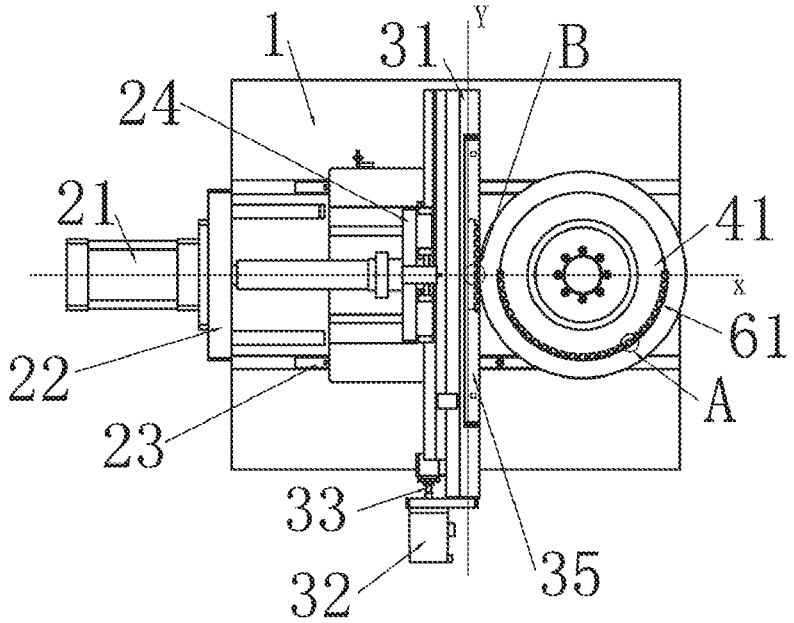
FIG. 2 is a top view of a vertical structure of an apparatus for printing a beer barrel in accordance with the present invention.
Figure 3:
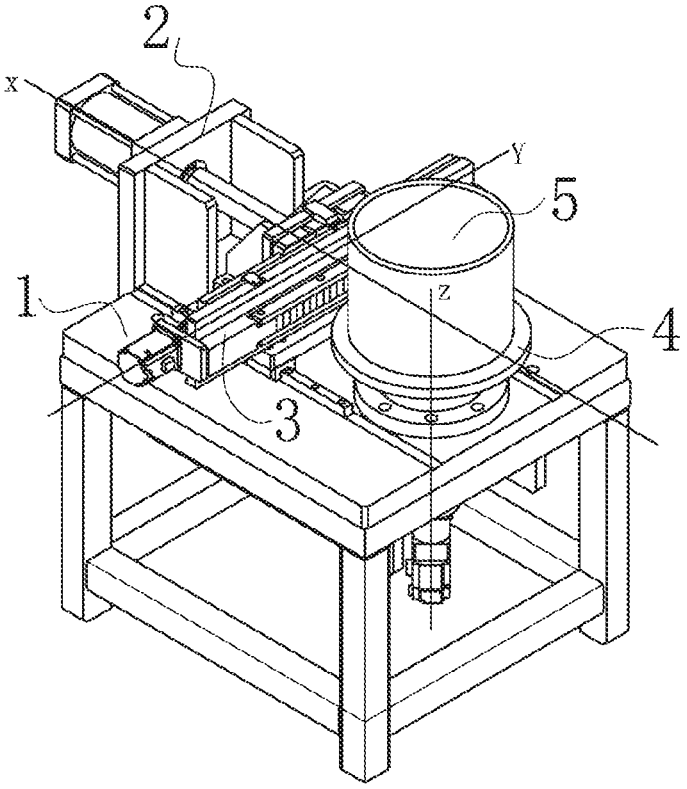
FIG. 3 is a perspective view of placing a barrel onto the apparatus for printing barrels as depicted in FIG. 1.
Figure 4:
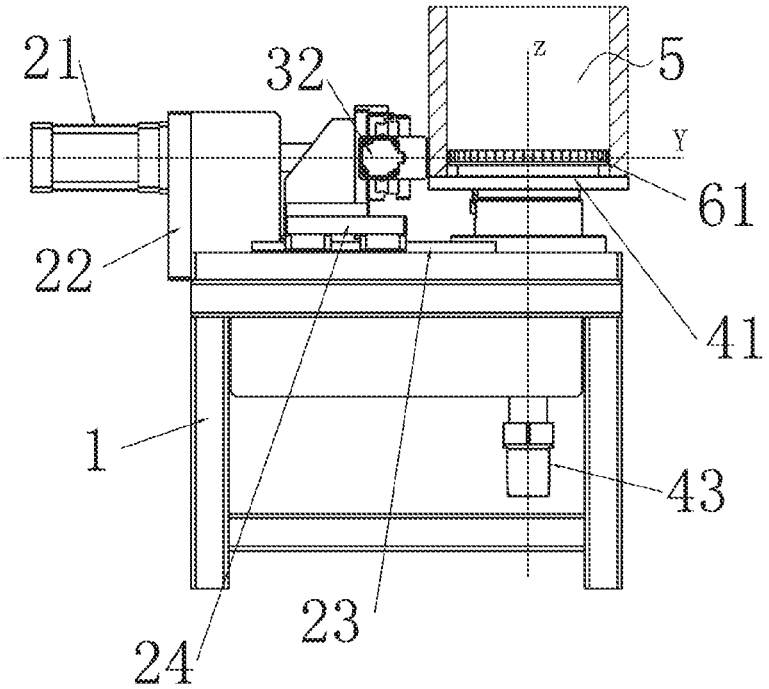
FIG. 4 is a front view of FIG. 3.
Figure 5:
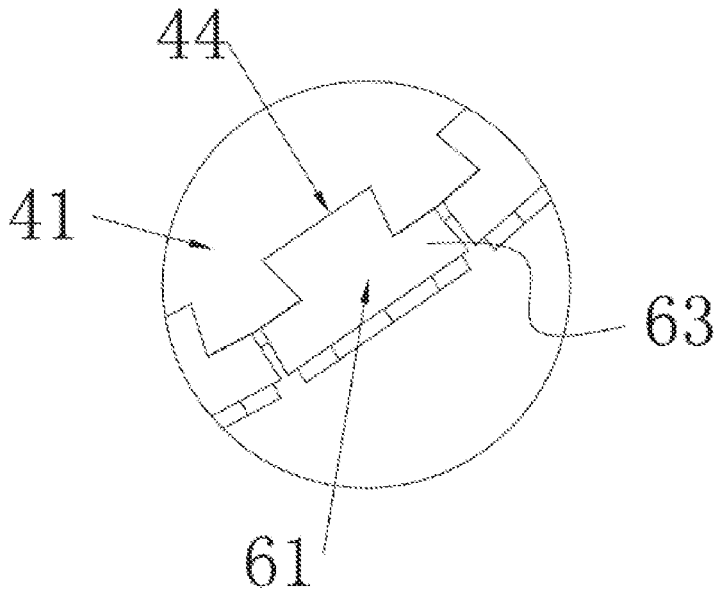
FIG. 5 is a blowup view of Section A of FIG. 2.
Figure 6:
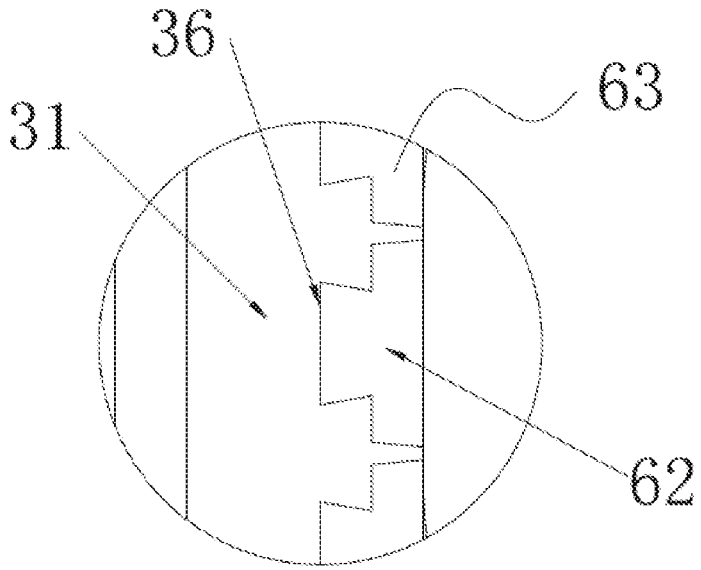
FIG. 6 is a blowup view of Section B of FIG. 2.
Figure 7:
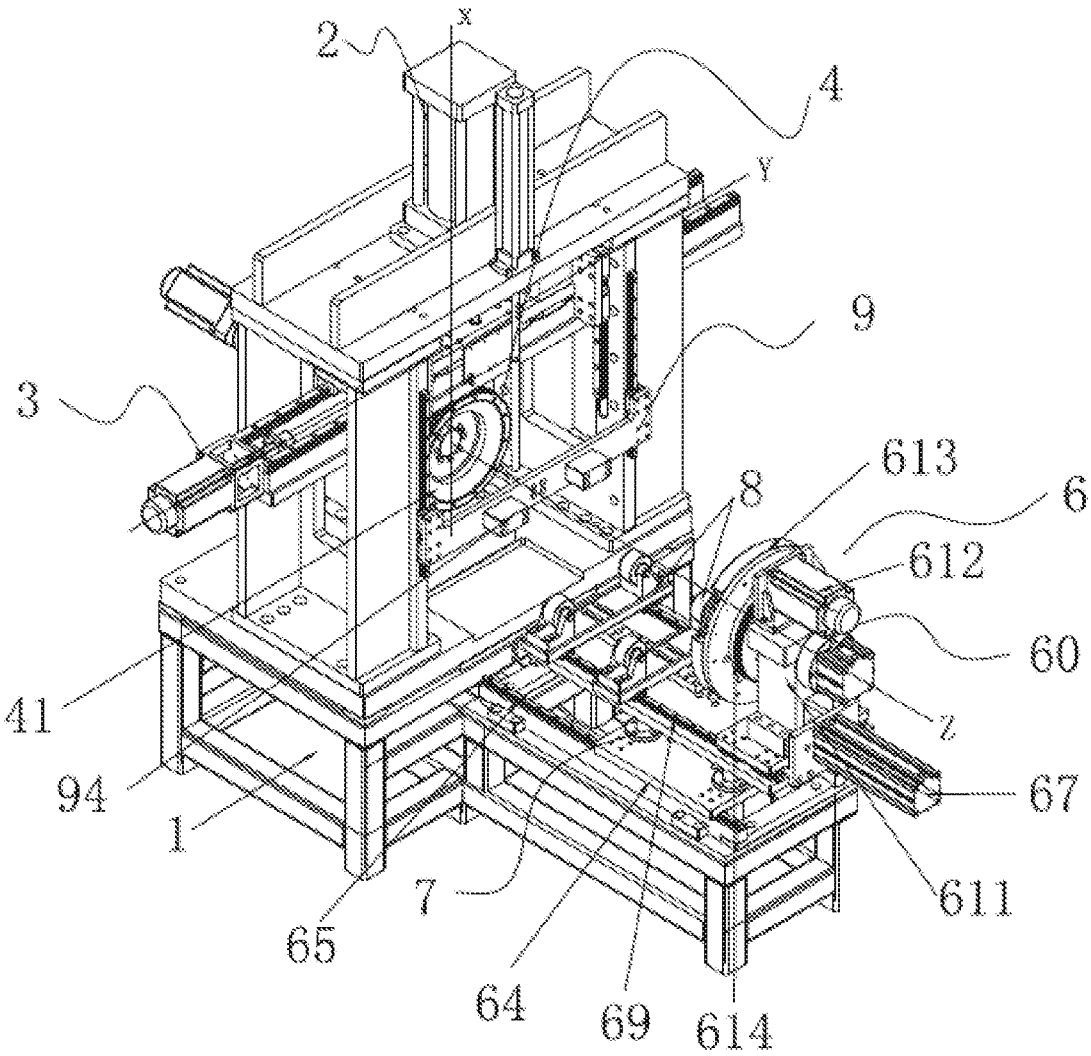
FIG. 7 is a perspective view of a horizontal structure of an apparatus for printing a beer barrel in accordance with the present invention.

With reference to FIGS. 3 to 6, both of the inner mold 61 and the outer mold 62 include at least a matrix 63, wherein the matrix 63 in the single inner mold 61 and the matrix 63 in the single outer mold 62 are paired to form a matrix element for printing a single text. Both upper and lower ends of the matrix 63 in the outer mold 62 have a fixing plate 35 (as shown in FIGS. 1 and 2) coupled to the connecting frame 31 to abut and fix the matrix 63. At least a dovetail notch 44, 36 of the same size is formed on a circumferential surface of the turntable 41 and a Y-axis plane of the connecting frame 31 separately, and each matrix 63 is of the same size. The back side of the matrix 63 is latched into the dovetail notch 44, so that the matrix 63 is installed on the Y-axis plane of the connecting frame 31 and the circumferential surface of the turntable 41 separately. If we need to print the mark "ABCD", the traditional matrix printing tool with the inner mold 61 and the outer mold 62 designed as a whole is an integral matrix engraved with the characters "ABCD", and such traditional matrix printing tool must be changed if we need to print the mark "EFCD". Since these two marks are completely different, it is necessary to manufacture a new matrix printing tool. On the other hand, the structure of the matrix printing tool of the present invention with the marks "ABCD" which may be divided into four matrix elements of single text, respectively "A", "B", "C" and "D". If it is necessary to change the mark to "E", "F", "C" and "D", the texts "A" and "B" originally installed on the matrix element will be replaced by "E" and "F" (installed into the corresponding dovetail notches (44, 36), and the texts "C" and "D" will be kept. In other words, only the matrix elements "C" and "D" can be used universally and interchangeably. Of course, if we need to replace the original mark "EFCD" by "ACBD", the order of "A", "B", "C", "D" is changed to "A", "C", "B", "D" (In other words, the matrixes "A", "C", and "B" are installed into the corresponding ordered dovetail notches 44, 36). This invention provides excellent versatility and interchangeability of the matrix, not just saving the time of changing the mold only, but also skipping the manufacture of several matrix printing tools for different marks. The invention saves the manufacturing cost of the mold and the manufacturing time. When the matrix 63 of the connecting frame 31 is pressed towards the turntable in the X-axis direction, the printing of a single matrix element is completed. If the X-axis and the diameter of the turntable are situated on a straight line, then the matrix 63 of the connecting frame 31 at the linear position and the matrix 63 of the turntable 41 at the linear position can be used for normal printing, and such structure can print the single text of the mark.

With reference to FIGS. 1 to 6 and 14 for a process for printing beer barrels in accordance with the present invention, the process comprises the following steps:

Step S10: Install a matrix element onto the Y-axis plane of a connecting frame and the circumferential surface of a turntable separately and arrange and label a plurality of corresponding single texts. In the Step S10, if the text and order of the matrix element used in Step S10 are the same as those of the previously installed matrix element, then the previous matrix element will be kept to achieve the effect of providing excellent versatility and interchangeability of the matrix, and such arrangement not just saves the time of changing the mold only, but also skips the manufacture of several matrix printing tools with different marks. Therefore the invention can save the manufacturing cost and manufacturing time of the mold.

Step S20: Sheath a stretched and welded barrel on the turntable 41, such that the inner side of the barrel is configured to be corresponsive to a matrix 63 of a male die structure in a matrix element, and the outer side of the barrel is configured to be corresponsive to a matrix 63 of a female die structure in the matrix element, and the connecting frame moves the turntable 41 along the X-axis. In addition, a normal printing position is designed between the matrix 63 of the male die structure and the matrix 63 of the female die structure in a single matrix element. Now, the positions of the matrix 63 of the first female die structure and the matrix 63 of the first male die structure are at the printing positions (wherein if the X-axis and the diameter of the turntable are situated on a straight line, the matrix 63 of the connecting frame 31 at the linear position and the matrix 63 of the turntable at the linear position can be used for a normal printing, and such linear positions are printing positions).

Step S30: Move the connecting frame 31 along the X-axis, such that the matrix 63 of the first female die structure touches the sidewall of the barrel, and operates together with the matrix 63 of the first male die structure to print a first text of a mark printed on the sidewall of the barrel, and then move the connecting frame 31 in an opposite direction along the X-axis, such that the matrix 63 of the first female die structure and the matrix 63 of the first male die structure are separated from each other.

Step S40: Move the connecting frame 31 along the Y-axis after the separation of the matrixes 63, such that the matrix of the next female die structure is moved with a corresponding distance to the printing position. Since the printed sidewall of the barrel is latched into the first matrix element, therefore the sidewall of the barrel is still pressed on the matrix of the male die structure when the matrix of the female die structure is separated from the sidewall of the barrel along the X-axis. The turntable drives the barrel to rotate along the Z-axis, and the turntable 41 rotates to a corresponding distance along the Z-axis, and the barrel 5 and the matrix of the next male die structure are also rotated to the printing positions, so that the turntable may mount barrels of different sizes or specifications without requiring the manufacture of several turntables of different sizes. This invention further reduces the manufacturing cost of the apparatus for printing a beer barrel, and the method as described in Step 3 is used for printing the barrel.

Step S50: Use the method as described in Step S40 to print the remaining text, so as to complete pressing the whole mark.

This process can simplify the manufacturing procedure, and improve the interchangeability of the matrix, so as to reduce the manufacturing cost and time of the mold and provide a convenient operation.

With reference to FIGS. 8 to 13 and 15 for a horizontal structure of an apparatus for printing a beer barrel in accordance with a second embodiment of the present invention, the apparatus comprises a workbench 1 and a hydraulic pushing device 2, a barrel outer-sided printing device 3 and a barrel inner-sided printing device 4 installed on the workbench 1 and controlled independently. Both of the barrel inner-sided printing device 4 and the barrel are disposed horizontally (along the Z-axis), and the barrel outer-sided printing device 3 is disposed in a front-rear direction (along the Y-axis) and above the barrel inner-sided printing device 4, and the hydraulic pushing device 2 is disposed vertically (along the X-axis. T). The structure of this embodiment is arranged in a position different from the position of the first embodiment, but the specific structure and function are the same as those of the first embodiment, except that this embodiment further has other functions.

Figure 8:
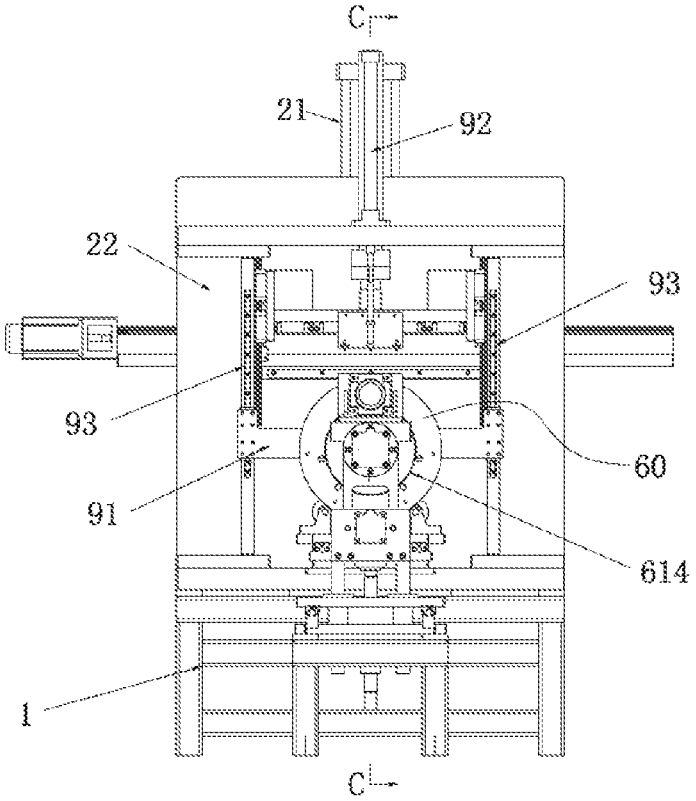
FIG. 8 is a right side view of a horizontal structure of an apparatus for printing a beer barrel in accordance with the present invention.
Figure 9:
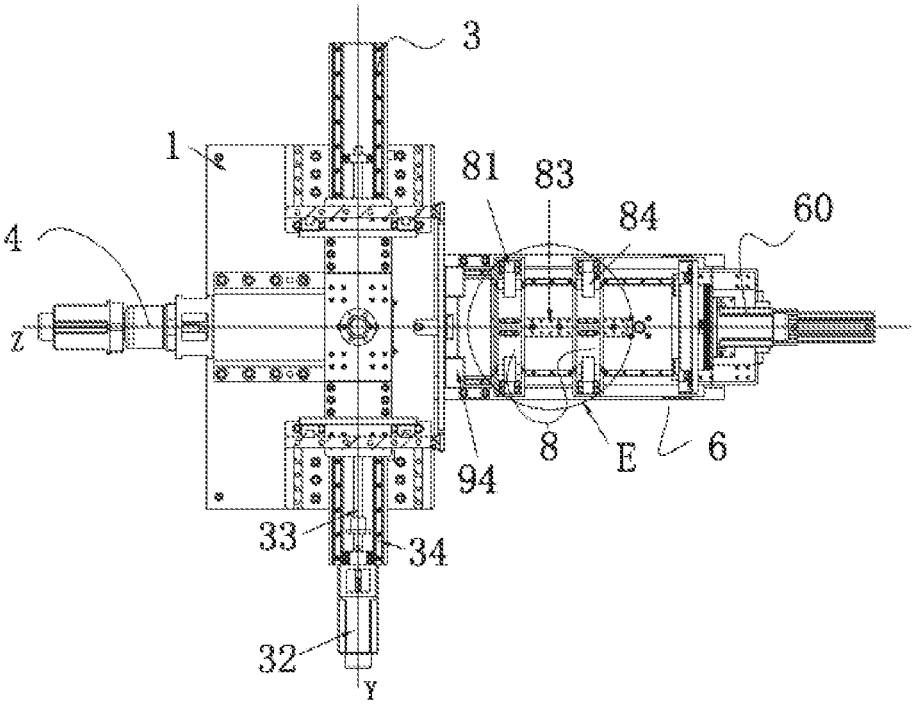
FIG. 9 is a top view of a horizontal structure of an apparatus for printing a beer barrel in accordance with the present invention.
Figure 10:
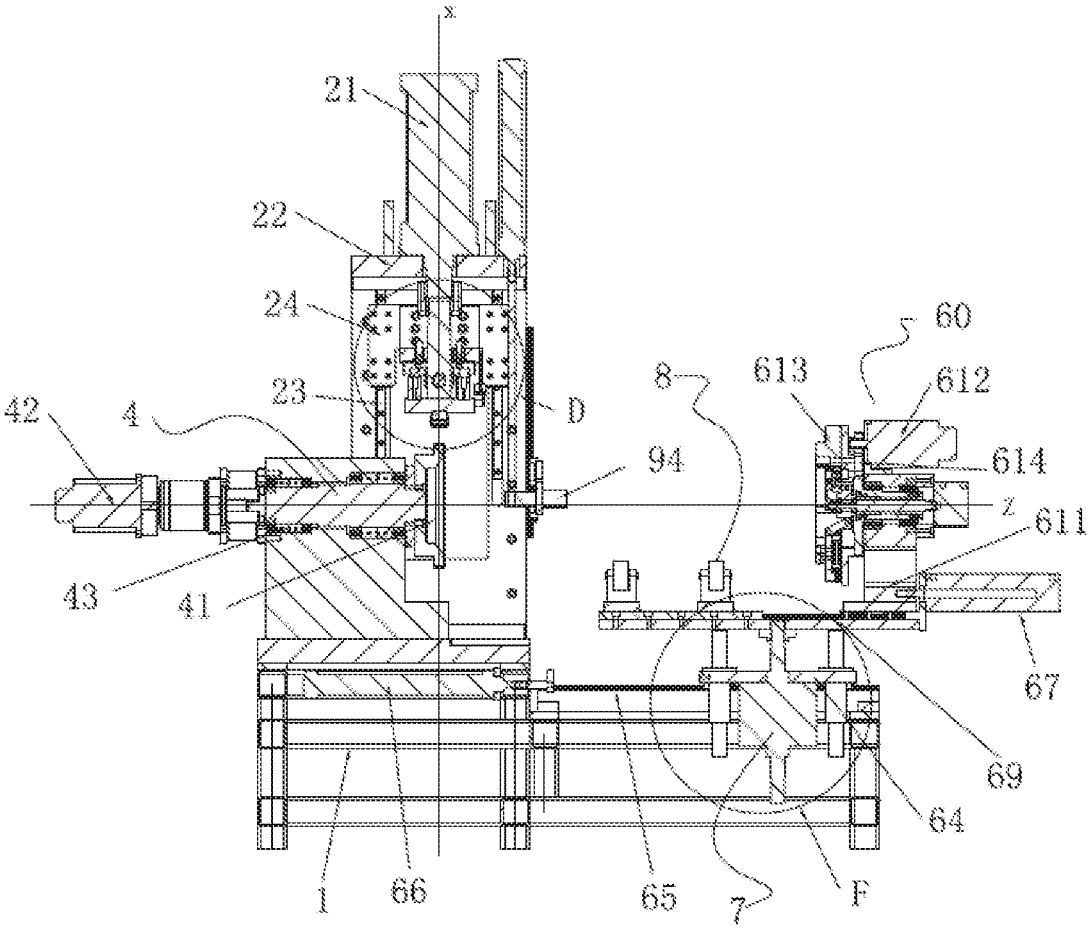
FIG. 10 is a cross-sectional view of Section C-C of FIG. 8.
Figure 11:
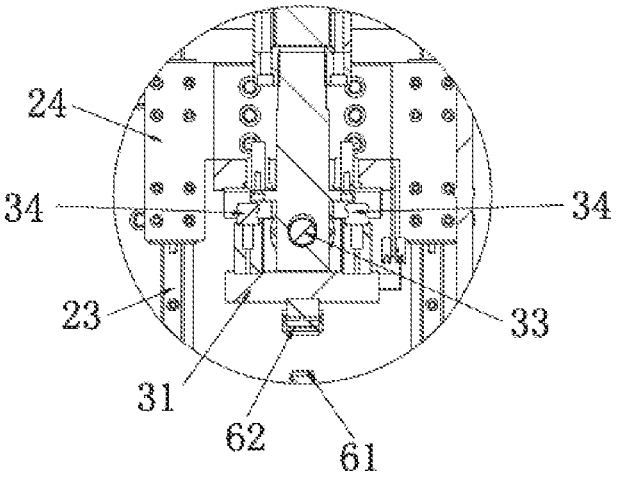
FIG. 11 is a blowup view of Section D of FIG. 10.

In FIGS. 8, 9 and 10, the apparatus of this embodiment comprises a barrel driving mechanism 6, and the barrel driving mechanism 6 comprises a 3-jaw positioning tool 60, a third guide rail 65, a fourth guide rail 69, a placement plate 64, a Z-axis cylinder 66, a first cylinder 67 and a lifting mechanism 7. The 3-jaw positioning tool 60 is provided for fixing an end of the barrel 5 and rotating the barrel 5, and the third guide rail 65 and the fourth guide rail 69 are disposed on the workbench 1 and the lifting mechanism 7 respectively and arranged parallel to the Z-axis, and the placement plate 64 is installed onto the third guide rail 65 and moved linearly along the third guide rail 65 by the Z-axis cylinder 66, and the 3-jaw positioning tool 60 is installed onto the fourth guide rail 69 and moved linearly along the fourth guide rail 69 by the first cylinder 67, so that the barrel 5 can be moved and placed at the printing position.

In FIG. 10, the 3-jaw positioning tool 60 comprises a chuck mount 611, a chuck servomotor 612 and a 3-jaw chuck 613 arranged coaxially with the turntable 41. The 3-jaw chuck 613 may be a pneumatic structure, and the 3-jaw chuck 613 is installed onto the fourth guide rail 69 by the chuck mount 611 and rotated axially, and a gear 614 arranged coaxially with the 3-jaw chuck 613 is installed onto the back side of the 3-jaw chuck 613, and the chuck servomotor 612 is fixed to the chuck mount 611, and a small gear is installed axially onto a shaft of the chuck servomotor 612 and engaged with the gear 614, so that the barrel 5 can be axially and independently rotated with respect to the turntable 41, and the power of the barrel 5 can be controlled independently.

Figure 13:
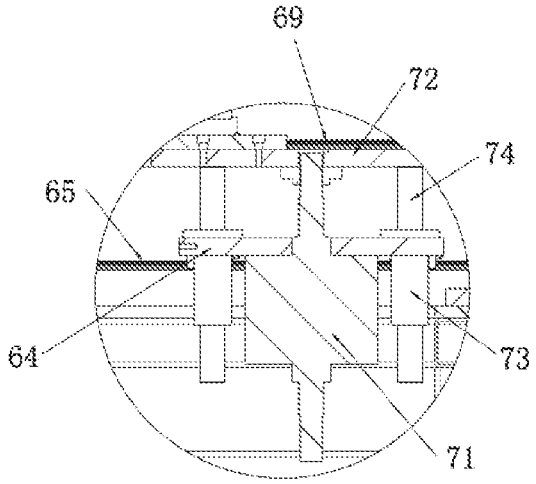
FIG. 13 is a blowup view of Section F of FIG. 10.
Figure 14:
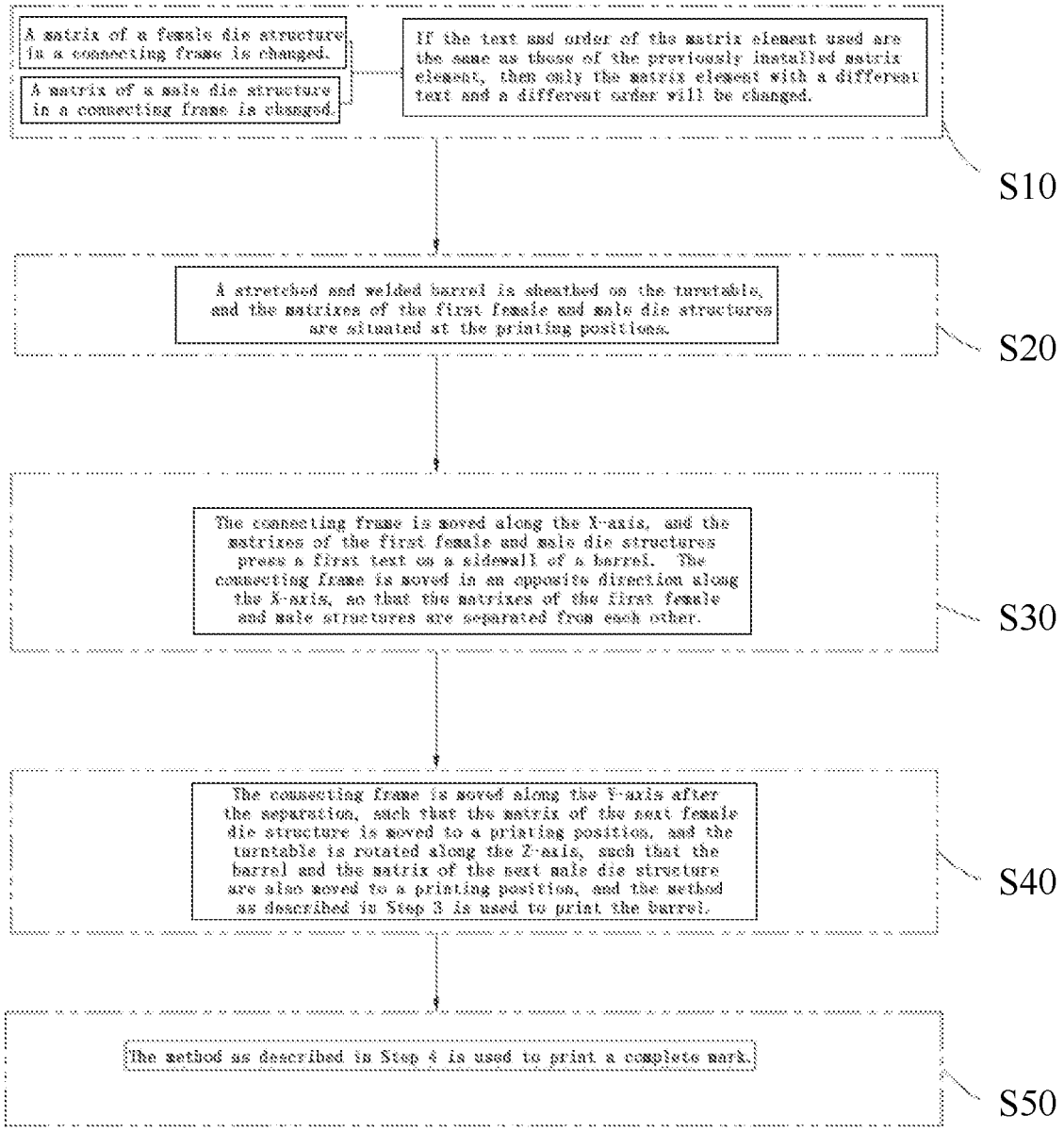
FIG. 14 is a flow chart of a process I for printing a beer barrel in accordance with the present invention.

In FIGS. 10 and 13, the lifting mechanism 7 comprises a lifting cylinder 71, a lifting plate 72 and a socket bar 73 and a guide rod 74 disposed at the periphery of the placement plate 64. The lifting cylinder 71 and the socket bar 73 are fixed onto the placement plate 64, and the guide rod 74 is slidably plugged into the socket bar 73 and whose top is fixed to the lifting plate 72 to improve the lifting function of the lifting plate 72. A lifting rod of the lifting cylinder 71 drives the lifting plate 72 to ascend and descend vertically, and the fourth guide rail 69 is installed onto the lifting plate 72, and the 3-jaw chuck 613 is installed onto the fourth guide rail 69 by the chuck mount 611, so as to control the barrel 5 positioned by the 3-jaw chuck 613 to ascend and descend vertically. After the text is printed, and the matrix 63 of the female die structure restores its original position by the hydraulic cylinder, the sidewall of the barrel 5 is still pressed on and latched to the matrix of the male die structure. As a result, the barrel 5 is moved upward to separate the barrel from the matrix of the male die structure on the turntable 41, and the turntable 41 and the barrel 5 can be rotated independently.

Figure 12:
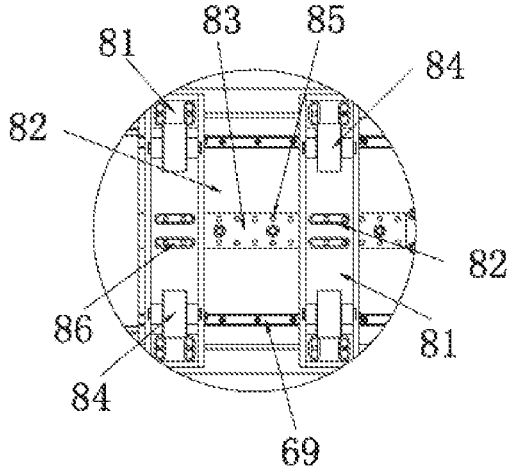
FIG. 12 is a blowup view of Section E of FIG. 9.

In FIGS. 9, 10 and 12, the apparatus of this embodiment further comprises a barrel placement mechanism 8, and the barrel placement mechanism 8 comprises two support members, each including a sliding seat 81, an adjustment mechanism 82, a positioning plate 83 installed onto the lifting plate 72 and a pair of symmetric rotating wheels 84 disposed on both left and right sides of the sliding seat 81 respectively. The outer circumferential surface of the rotating wheel 84 touches the outer wall of the barrel 5 to rotatably support the barrel 5, so as to reduce the friction with the barrel 5. Both left and right ends of the sliding seat 81 are installed onto the fourth guide rail 69 and the sliding seat 81 is moved linearly along the fourth guide rail 69. The positioning plate 83 is disposed at the top of the sliding seat 81 and comprises a plurality of adjustment holes 85 distributed along the Z-axis, and the sliding seat 81 is coupled to the adjustment hole 85 by the adjustment mechanism 82 to fit barrels 5 of different lengths.

The sliding seat 81 has a slotted hole 86, and the slotted hole 86 is fixed to the adjustment hole 85 by the adjustment mechanism 82.

In FIG. 9, the apparatus of this embodiment further comprises an abutting mechanism 9 disposed at the top of the barrel placement mechanism 8, and the abutting mechanism 9 comprises a slide block 91, a second cylinder 92, a fifth guide rail 93 and a pair of symmetric abutting block 94 disposed on both left and right sides of the slide block 91 respectively. Both of the fifth guide rail 93 and the second cylinder 92 are installed onto the hydraulic cylinder mount 22, wherein the fifth guide rail 93 is parallel to the X-axis, and the slide block 91 is installed onto the fifth guide rail 93 and pushed by the second cylinder 92 to slide linearly along the fifth guide rail 93, and an axial end of the barrel 5 is latched to the 3-jaw chuck 613, and the other end of the barrel 5 abuts against the abutting block 94, so that the barrel 5 is coupled closely with the 3-jaw chuck 613 and positioned more accurately. In addition, the abutting block 94 abuts against a middle position of the barrel to further improve the accuracy and the latching effect of the 3-jaw chuck 613. Further, the abutting block 94 is made of nylon to minimize any possible scratch to the sidewall of the barrel.

This apparatus further comprises a program for embossing serial numbers, and the program can be used for printing a respective serial number to a next barrel, and the serial number is corresponsive to the matrix. When the next barrel is printed, the corresponding matrix is retrieved. For example, if we want to print 20150703-001 on this barrel and 20150703-002 on the next barrel, so that each barrel has a unique serial number, then we will simply need to input a first serial number and then change the serial number according to a sequence without the need of changing text or re-enter the information. The operation is very convenient.

Figure 15:
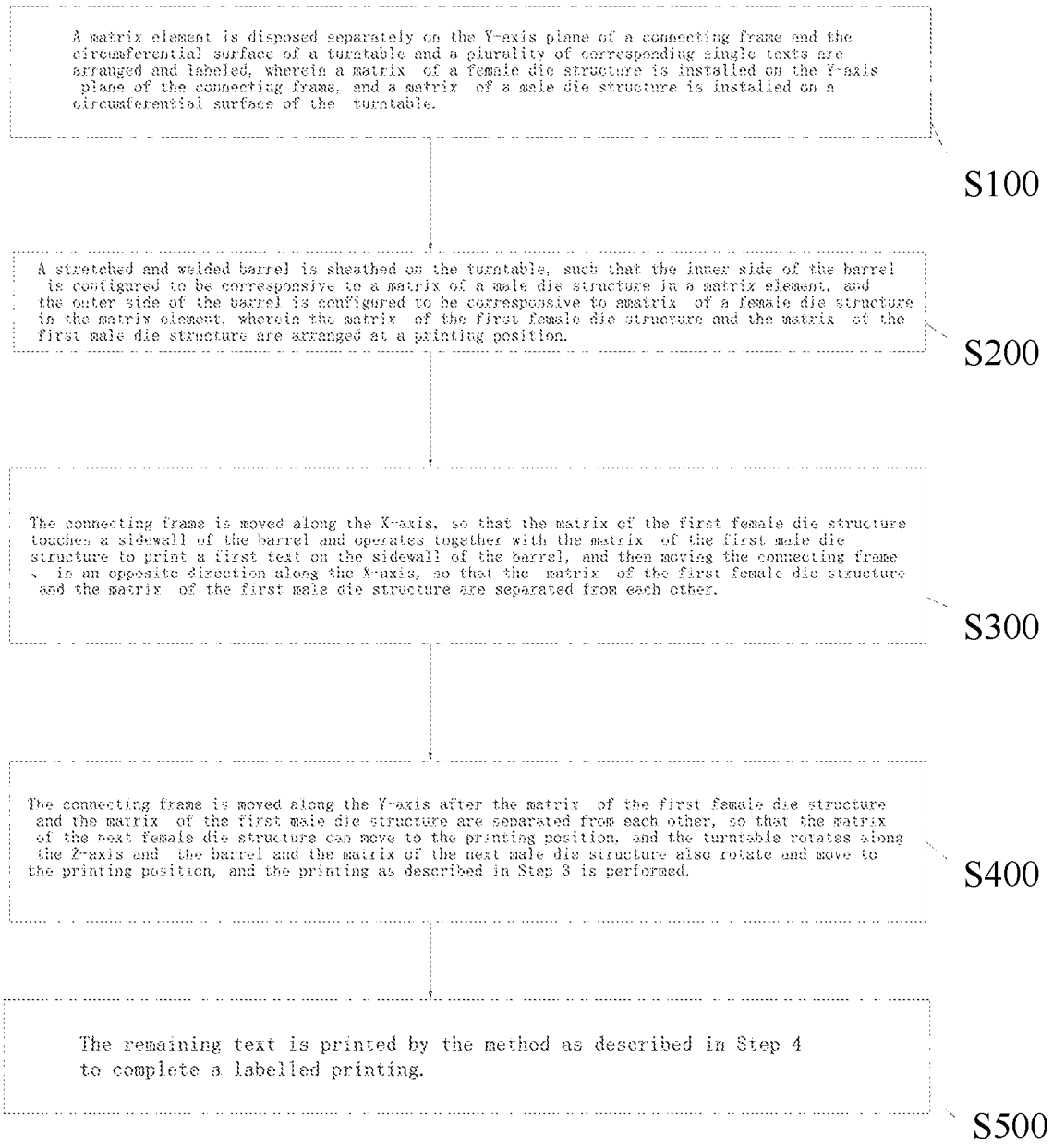
FIG. 15 is a flow chart of a process II for printing a beer barrel in accordance with the present invention.

With reference to FIG. 15 for the flow chart of a process II of the second embodiment of this invention, the process comprises the following steps:

Step S100: Install a matrix element onto the Y-axis plane of a connecting frame and the circumferential surface of a turntable separately and arrange and label a plurality of corresponding single texts, wherein a matrix of a female die structure is installed on the Y-axis plane of the connecting frame, and a matrix of a male die structure is installed on a circumferential surface of the turntable.

Step S200: Place a stretched and welded barrel 5 horizontally on a rotating wheel 84 and move the abutting block 94 downwardly to a middle position of the barrel 5, wherein after the first cylinder 67 drives the 3-jaw chuck 613 to move towards the barrel 5 and touch the barrel 5, the 3-jaw chuck 613 is driven to move continuously until an axial end of the barrel 5 abuts against the 3-jaw chuck 613, and the other end of the barrel 5 abuts against the abutting block 94, and then the 3-jaw chuck 613 clamps the barrel 5 for the positioning purpose, and the abutting block 94 is moved upwardly and the Z-axis cylinder 66 controls the barrel 5 to move towards the turntable 41 and to the printing position.

Step S300: When the first text is printed, the connecting frame 31 automatically finds the matrix of the corresponding female die structure and moves the matrix to the printing position, and the turntable 41 automatically finds the matrix of the corresponding male die structure and rotate the matrix along the Z-axis to the printing position, and the hydraulic cylinder 21 moves the matrix of the female die structure along the X-axis for printing. After the printing is done, the matrix of the female die structure restores its original position along the X-axis, and the barrel 5 is separated from the matrix of the male die structure by the upward movement of the lifting cylinder.

Step S400: When the next text is printed, the 3-jaw chuck is controlled independently to rotate the barrel to an appropriate angle, and then the Step 3 is used for performing the operation.

Step S500: The method as described in Step S400 is used to print the remaining text to complete printing the whole mark.

While the invention has been described by means of specific embodiments, numerous modifications and variations could be made thereto by those skilled in the art without departing from the scope and spirit of the invention set forth in the claims.

What is claimed is:

1. An apparatus for printing a beer barrel, comprising: a workbench, and a hydraulic pushing device, a barrel outer-sided printing device and a barrel inner-sided printing device installed on the workbench; the barrel inner-sided printing device comprising a turntable rotating by using the Z-axis as an axis line and capable of mounting the barrel, and an inner mold installed on a circumferential surface of the turntable for printing an inner side of the barrel, and the barrel outer-sided printing device comprising a connecting frame moving linearly in the Y-axis direction, and the connecting frame having an outer mold installed thereon for printing an outer side of the barrel, and the hydraulic pushing device controlling the outer mold installed on the connecting frame to move linearly in the X-axis direction, so that the outer mold and the inner mold can print the side walls of the barrel correspondingly;

wherein the apparatus further comprises a barrel driving mechanism and the barrel driving mechanism comprising a 3-jaw positioning tool for positioning the barrel and controlling the barrel to rotate axially and independently, and the 3-jaw positioning tool and the turntable being coaxial with each other and capable of moving axially.

2. The apparatus for printing a beer barrel according to claim 1, wherein the hydraulic pushing device comprises a hydraulic cylinder, a hydraulic cylinder mount, a first guide rail and a moving rack; the hydraulic cylinder is installed on the workbench by the hydraulic cylinder mount, and the first guide rail is laid on a tabletop of the workbench, and the moving rack is mounted on the first guide rail and moved linearly in the X-axis direction by a pushrod of the hydraulic cylinder.

3. The apparatus for printing a beer barrel according to claim 2, wherein the barrel outer-sided printing device further comprises a Y-axis servomotor, a screw and a second guide rail; and the Y-axis servomotor, the screw and the second guide rail are installed onto the moving rack, and the Y-axis servomotor drives the screw to rotate, and an end of the connecting frame is mounted onto the second guide rail and slidably coupled along the Y-axis, and the other end of the connecting frame is spirally coupled to the screw.

4. The apparatus for printing a beer barrel according to claim 3, wherein the barrel inner-sided printing device further comprises a Z-axis servomotor and a bearing; the bearing is installed on the workbench, and the turntable is installed in the bearing, and the Z-axis servomotor—is installed at the bottom of the workbench for driving the turntable to rotate on the bearing—by using the Z-axis as an axis line.

5. The apparatus for printing a beer barrel according to claim 3, wherein the barrel driving mechanism —further comprises a third guide rail, a fourth guide rail, a placement plate, a Z-axis cylinder, a first cylinder and a lifting mechanism, wherein the third guide rail and the fourth guide rail—are disposed on the workbench and the lifting mechanism —respectively, and arranged parallel to the Z-axis, and the placement plate—is installed on the third guide rail and capable of moving linearly along the third guide rail—by the Z-axis cylinder, and the 3-jaw positioning tool—is installed on the fourth guide rail and capable of moving linearly along the fourth guide rail—by the first cylinder, and the lifting mechanism—is installed on the placement plate and provided for driving the 3-jaw positioning tool—to ascend and descend vertically.

6. The apparatus for printing a beer barrel according to claim 5, wherein the 3-jaw positioning tool —comprises a chuck mount, a chuck servomotor and a 3-jaw chuck —coaxially arranged with the turntable; the 3-jaw chuck—is installed on the fourth guide rail—by the chuck mount and rotatable axially, and a gear—is installed to the back side of the 3-jaw chuck and coaxially arranged with the 3-jaw chuck, and the chuck servomotor—is fixed onto the chuck mount and engaged with the gear, so that the barrel can independently and axially rotate with respect to the turntable, and the first cylinder—is provided for controlling the chuck mount—to move along the fourth guide rail.

7. The apparatus for printing a beer barrel according to claim 6, further comprising an abutting mechanism, and the abutting mechanism —comprising a slide block, a second cylinder, a fifth guide rail and a pair of abutting blocks symmetrically disposed on both left and right sides of the slide block; the fifth guide rail and the second cylinder —being installed on the hydraulic cylinder mount, wherein the fifth guide rail—is parallel to the X-axis, and the slide block—is installed on the fifth guide rail and pushed by the second cylinder—to move linearly along the fifth guide rail; the barrel has an axial end latched to the 3-jaw chuck and the other end abutting at least one of the abutting blocks.

8. The apparatus for printing a beer barrel according to claim 7, wherein at least one of the abutting blocks—abuts a middle position of the barrel.

9. The apparatus for printing a beer barrel according to claim 8, wherein at least one of the abutting blocks—is made of nylon.

10. The apparatus for printing a beer barrel according to claim 5, wherein the lifting mechanism —comprises a lifting cylinder, a lifting plate and a socket bar —disposed at the periphery of the placement plate and a guide rod; the lifting cylinder and the socket bar—are fixed onto the placement plate, and the guide rod—is slidably plugged into the socket bar and has a top fixed to the lifting plate, and a lifting rod of the lifting cylinder—is provided for driving the lifting plate—to ascend and descend vertically, and the fourth guide rail—is installed onto the lifting plate.

11. The apparatus for printing a beer barrel according to claim 5, further comprising a barrel placement mechanism; the barrel placement mechanism —comprises two support members, each including a sliding seat, an adjustment mechanism, a positioning plate—installed onto the lifting plate and a pair of rotating wheels symmetrically disposed on both left and right sides of the sliding seat —respectively; the rotating wheel—has an outer circumferential surface contacted with an outer wall of the barrel; both left and right ends of the sliding seat—are installed on the fourth guide rail and moved linearly along the fourth guide rail, and the positioning plate—is disposed at the top of the sliding seat and has a plurality of adjustment holes —distributed on the Z-axis, and the sliding seat—is coupled to the adjustment mechanism—by the adjustment hole.

12. The apparatus for printing a beer barrel according to claim 11, wherein the sliding seat—has a slotted hole —coupled to the adjustment hole—by the adjustment mechanism.

13. The apparatus for printing a beer barrel according to claim 1, wherein the inner mold and the outer mold include at least a matrix, and the matrix—of the single inner mold and the matrix of the single outer mold are paired to form a printing single text matrix element; the matrix—is installed on the Y-axis plane of the connecting frame and the circumferential surface of the turntable, and when the matrix—of the connecting frame is pressed along the X-axis and towards the turntable of the matrix, the printing of a single matrix element is completed.

14. The apparatus for printing a beer barrel according to claim 13, wherein both of the circumferential surface of the turntable and the Y-axis plane of the connecting frame have at least a dovetail notch—of the same size, and each matrix—is of the same size, and the back side of the matrix—is correspondingly latched into the dovetail notch, so that the matrix—is installed on the Y-axis plane of the connecting frame and the circumferential surface of the turntable.

15. The apparatus for printing a beer barrel according to claim 13, wherein when the X-axis and the diameter of the turntable are on a straight line, the matrix—of the connecting frame at the linear position and the matrix—of the turntable at the linear position can be used for normal printing.

16. A process II for printing beer barrels, comprising the steps of:

Step 1: installing a matrix element onto the Y-axis plane of a connecting frame and the circumferential surface of a turntable separately and arranging and labeling a plurality of corresponding single texts, wherein a matrix—of a female die structure is installed on the Y-axis plane of the connecting frame, and a matrix—of a male die structure is installed on a circumferential surface of the —turntable;

Step 2: positioning an end of a stretched and welded barrel by a 3-jaw chuck and moving the barrel to a printing position, such that the inner side of the barrel is configured to be corresponsive to a matrix of a male die structure and the outer side of the barrel is configured to be corresponsive to a matrix—of a female die structure;

Step 3: automatically finding the matrix of the corresponding female die structure and moving the matrix to a printing position by the connecting frame —when a first text is printed, and automatically finding the matrix of the corresponding male die structure and rotating the matrix along the Z-axis to a printing position by the turntable, and moving the matrix—of the female die structure along the X-axis by a hydraulic cylinder and operating together with the matrix—of the male die structure for printing, and restoring the matrix—of the female die structure to its original position after the printing is completed, and lifting the barrel by a lifting cylinder—to separate the barrel from the matrix—of the male die structure;

Step 4: printing a next text, and controlling a 3-jaw chuck —independently to rotate the barrel to an appropriate angle first, and then performing the operation as described in Step 3; and Step 5: using the method as described in Step 4 to print the remaining text, so as to complete the labeled printing.

17. The process II for printing beer barrels according to claim 16, wherein the barrel, the connecting frame, and the turntable have an independently controlled power.

18. The process for printing beer barrels according to claim 16, wherein in Step 2, the barrel is placed horizontally on a barrel placement mechanism, and the 3-jaw chuck—is moved towards the barrel, so that both ends of the barrel abut against an abutting mechanism and the 3-jaw chuck, and then the 3-jaw chuck—connects and positions the barrel, and the abutting mechanism —restores its original position along the X-axis, and then the barrel is sent to a printing position.

* * * * *